US007993252B2

(12) United States Patent
Barrie et al.

(10) Patent No.: US 7,993,252 B2
(45) Date of Patent: Aug. 9, 2011

(54) EXERCISE DEVICE

(75) Inventors: Alexander Barrie, Harrow (GB); Jeffrey James, London (GB)

(73) Assignee: Backchamp Holdongs Ltd., Newport (GB)

( * ) Notice: Subject to any disclaimer, the term of this patent is extended or adjusted under 35 U.S.C. 154(b) by 0 days.

(21) Appl. No.: 12/066,471

(22) PCT Filed: Sep. 12, 2006

(86) PCT No.: PCT/GB2006/003372

§ 371 (c)(1), (2), (4) Date: Jul. 18, 2008

(87) PCT Pub. No.: WO2007/031731

PCT Pub. Date: Mar. 22, 2007

(65) Prior Publication Data

US 2008/0293552 A1 Nov. 27, 2008

(30) Foreign Application Priority Data

Sep. 13, 2005 (GB) ..... 0518702.6

(51) Int. Cl.
*A63B 26/00* (2006.01)

(52) U.S. Cl. ..... 482/140

(58) Field of Classification Search ..... 482/126, 482/140, 148, 51–52, 907, 91, 139
See application file for complete search history.

(56) References Cited

U.S. PATENT DOCUMENTS

| | | | | |
|---|---|---|---|---|
| 552,971 | A | 1/1896 | Sandow | |
| 3,475,022 | A | 10/1969 | Hansen et al. | |
| 4,817,944 | A | 4/1989 | Anderson et al. | |
| 5,697,873 | A * | 12/1997 | Van Straaten | 482/126 |
| 5,713,823 | A * | 2/1998 | Walendzak et al. | 482/142 |
| 5,752,903 | A * | 5/1998 | Chang | 482/141 |
| 5,941,802 | A * | 8/1999 | Kiser | 482/92 |
| 6,022,297 | A * | 2/2000 | DeJesus | 482/70 |
| 6,065,210 | A * | 5/2000 | Bove | 29/895.21 |
| 6,110,082 | A * | 8/2000 | Tsai | 482/121 |
| 2004/0099478 | A1 | 5/2004 | Yim et al. | |
| 2005/0113222 | A1 * | 5/2005 | Dovner et al. | 482/121 |

FOREIGN PATENT DOCUMENTS

WO WO-2006/130764 A1 12/2006

* cited by examiner

*Primary Examiner* — Lori Baker
(74) *Attorney, Agent, or Firm* — Winstead PC

(57) ABSTRACT

The invention provides an exercise device (10) comprising an elongate member (20) and an engagement member (30) having an engagement region (40), the engagement member defining an aperture (35) therethrough, the elongate member extending through the aperture, such that when the engagement region is under substantially no load, the engagement member is slideable along the elongate member and when the engagement region is placed under load, the engagement member is substantially non-slideable along the elongate member. Also provided is a method of pelvic realignment involving use of said exercise device.

13 Claims, 2 Drawing Sheets

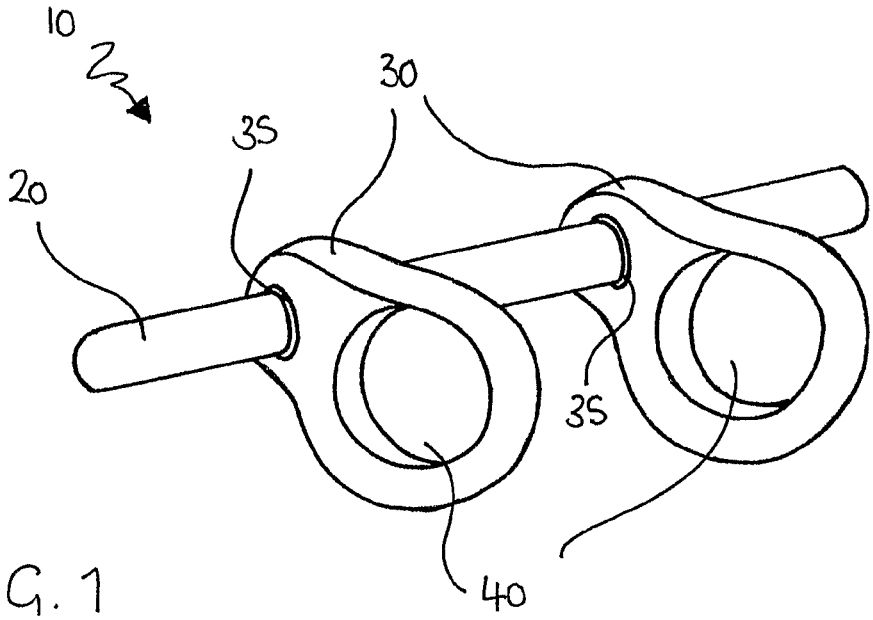
FIG. 1
FIG. 2
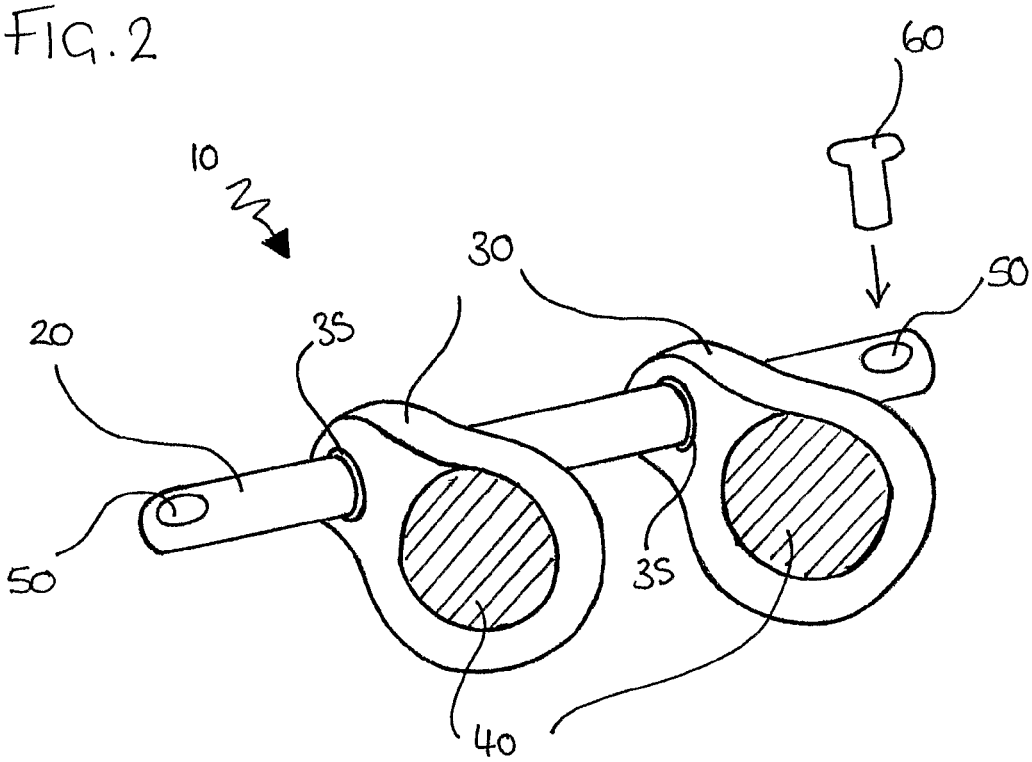

EXERCISE DEVICE

FIELD OF THE INVENTION

The present invention relates generally to an exercise device and exercise therapy using said device. More specifically, this invention relates to an exercise device to relieve or eliminate hip and/or back pain by realignment of the pelvis, and a method of use of said exercise device.

BACKGROUND OF THE INVENTION

Back pain can be a chronic, extremely painful and often debilitating experience for sufferers, resulting in a highly compromised lifestyle and often contributes to long term absences from the workplace. There are many causes of back pain, such as injury, disease, obesity, overuse, aging, childbirth, and the like.

In many instances, back and other musculo-skeletal pains are due to pelvic dislocation. Pelvic dislocation is a common occurrence, and is medically identified by observing, amongst other indicators, leg length discrepancy.

Pelvic dislocation results in compromised horizontality of the pelvis, and is overcome by realigning the pelvis with the horizontal plane to enable the vertebrae of the spine to sit squarely above the pelvis. In this way, a natural and healthy skeletal physiology is obtained.

Amongst other problems encountered by sufferers of a mis-aligned pelvis is a side-to-side tilt of the pelvis, resulting in the segments of the spine sitting on an oblique angled pelvis, rather than a proper horizontal pelvis. This inevitably results in distortion of the spinal system with resultant aches and pains.

Without proper realignment of the pelvis to restore pelvic stability and proper angularity, the spinal system distortion and aches and pains resulting from a misaligned pelvis are unlikely to be overcome.

Although pelvic instability is often diagnosed, few therapists are able to effectively treat such conditions and make the necessary adjustments to the pelvis in order to return it to its proper alignment. When pelvic misalignment has been diagnosed, a treatment session with a chiropractor or the like may well result in proper realignment of the pelvis. However, more often than not, the pelvic dysfunction will return shortly after the session is over.

Prior art devices exist, the use of which is intended to alleviate back pain by means of associated exercises. However, such devices and their associated exercises are often ineffective, or difficult for the patient to carry out in private without the aid of a therapist present to assist, or are so difficult to use or unwieldy that prolonged use of the device is not practical for the patient.

Therefore, there exists a need for a device which is simple to use and can be used by a patient, either independently of a therapist, or in combination with existing therapist supervised treatments, to effect pelvic realignment in an effective way, such that repeated performance of the associated exercises results in alleviation of back pain coupled with progressive realignment of the pelvis to restore its natural and proper alignment.

The present invention seeks to address the problems of the prior art.

SUMMARY OF THE INVENTION

A first aspect of the present invention provides an exercise device comprising an elongate member and an engagement member having an engagement region, the engagement member defining an aperture therethrough, the elongate member extending through the aperture, such that when the engagement region is under substantially no load, the engagement member is slid able along the elongate member and when the engagement region is placed under load, the engagement member is substantially non-slideable along the elongate member.

The term exercise device is intended to include any device which is used in combination with muscular effort on the part of a user, and is intended to include medical devices which a user operates using muscular effort.

In one embodiment, the exercise device comprises a further engagement member, each engagement member having an engagement region, each engagement member defining an aperture therethrough, the elongate member extending through each aperture such that when an engagement region is under substantially no load, the respective engagement member is slideable along the elongate member and when an engagement region is under load, the respective engagement member is substantially non-slideable along the elongate member.

The two engagement members may be independently slideable along the elongate member when the engagement regions are under substantially no load.

Alternatively, the second engagement member may be fixed relative to the elongate member such that only one engagement member is slideable along the elongate member when the engagement regions are under substantially no load.

In the present invention, when the engagement region of the engagement member is placed under load, the engagement member is substantially non-slideable along the elongate member. This is due to frictional forces which come into play between the engagement member and the elongate member when force is exerted on the engagement region. This sliding cantilever locking arrangement allows the engagement member to act as a fixed surface on application of pressure by the knees of a user through the engagement region of the engagement member.

In one embodiment, the aperture in the or each engagement member is substantially elliptical in shape. It is preferred that the cross-section of the elongate member is also substantially elliptical in shape, being dimensioned so as to be able to pass through the aperture in the engagement member.

However, it will be appreciated that any other suitable cross-sectional shapes which allow the frictional forces between the elongate member and the engagement member to come into play on application of a force to the engagement region of the engagement member could be used. For example, even if the cross-sectional shape of the aperture within the engagement member were to be substantially ovoid in shape, it will be appreciated that an elongate member of cross-sectional shape substantially resembling an ovoid may still allow a fit between the elongate member and the engagement member such that application of a force to the engagement region of the engagement member results in the engagement member becoming fixed in position relative to the elongate member and thus being rendered non-slideable along the elongate member.

In one embodiment of the invention, the elongate member comprises a first retention means located substantially adjacent a first end thereof. The elongate member may be further provided with a second retention means located distal to the first retention member.

Such a retention means may comprise a retention aperture in the elongate member provided substantially adjacent one end of the elongate member, the retention aperture being adapted to receive a retention member, such as a retention pin therethrough so as to retain the or each engagement member in engagement with the elongate member. The provision of such retention means and member would provide an obstruction substantially adjacent each end of the elongate member which would prevent the or each engagement member from being slideable along the elongate member and released from the elongate member. Should the or each engagement member be moved along the elongate member towards the end of the elongate member, the or each engagement member would encounter the retention means and member, which would obstruct the passage of the or each engagement member along the elongate member, thereby retaining the or each engagement member in engagement with the elongate member.

In one embodiment, at least a portion of the engagement region comprises a resilient material, such as silicon. Alternative resilient materials include, but are not limited to, rubber, foam, plastic, leather and the like. Alternatively, the engagement region may be provided with an aperture or opposing concave contoured surfaces which, in use, facilitate location of the knees of a user in the correct position relative to the engagement member of the medical device.

At least a portion of the elongate member of an exercise device according to the present invention may comprise a wood material. In one embodiment, at least a part of the elongate member comprises wood, such as beechwood, although it will be appreciated that any other suitable wood could be used, in solid form or in plywood form. Alternatively, part or all of the elongate member of the exercise device may comprise materials such as, but not limited to, metal, plastic or toughened glass. It will be appreciated that any other suitable material known to the skilled person could be used as an alternative.

Similarly, at least a portion of the engagement member may comprise wood or any other suitable material such as metal, plastic or glass material or any other suitable material known to the skilled person.

In one embodiment, the exercise device is used for carrying out pelvic realignment exercises. In such instances, the exercises associated with use of the device for realignment of the pelvis of a user are discussed below.

A further aspect of the present invention provides a method of pelvic realignment comprising the steps of placing a device according to a previous aspect adjacent the knees of a user, with the or each engagement region of the device located between the knees of a user such that pressure is exerted on the engagement region by the knees by movement of the knees towards one another.

A further aspect of the present invention provides a method of pelvic realignment comprising the steps of placing a device according to any preceding aspect between the knees of a user with the or each engagement region of the device located outside the knees of a user, such that pressure is exerted on the or each engagement region by the knees by movement of the knees away from one another.

Use of an exercise device according to the present invention not only facilitates proper alignment of the pelvis of a user, but also allows the user, through repeated use, to quickly, safely and effectively maintain their healthy pelvic alignment. Thus, the device is suitable for use in isolation and is also suitable for use in combination with therapist-administered treatments to help maintain proper pelvic alignment between sessions with a therapist.

DETAILED DESCRIPTION OF THE INVENTION

Embodiments of the present invention will now be described, by way of example only, and with reference to the following figures, in which:

FIG. 1 is a perspective view of a first embodiment of a device according to the present invention;

FIG. 2 is a perspective view of a further embodiment of a device according to the present invention.

Figure 3B:
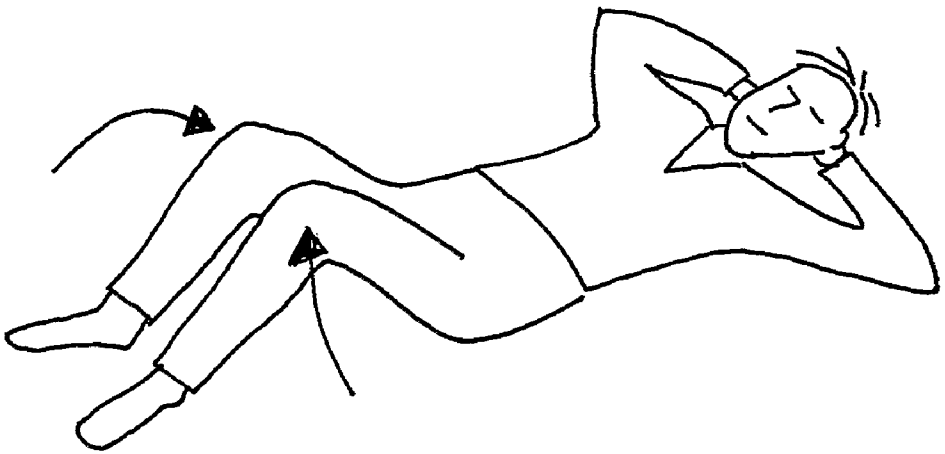
FIGS. 3A and 3B are illustrations of a user in position to carry out use of a device according to the present invention.

FIG. 1 illustrates a first embodiment of a medical device 10 according to the present invention. Medical device 10 comprises an elongate member 20 and engagement members 30, each engagement member 30 provided with an aperture 35 therethrough, through which, in use, elongate member 20 is received. Each engagement member 30 is further provided with an engagement region 40. In use, engagement region 40 is contacted by the knees of a user. Engagement region 40 may comprise an aperture, such as shown in FIG. 1. Alternatively, engagement region 40 may comprise a region with opposing concave surfaces. Alternatively, engagement region may comprise a resilient region, such as a padded region such as shown in FIG. 2, thus providing a region on opposing sides of engagement member 30 at which the knees of a user are located in use, which is cushioned for the comfort of a user.

It will be appreciated that any other form of engagement region 40 may be provided, as long as the engagement region 40 is capable of facilitating contact with the knees of a user during use of medical device 10.

In FIG. 2, elongate member 20 is provided with retention means 50, which are illustrated as apertures located at distal ends of elongate member 20, into which a retention pin 60 may be received, thereby preventing removal of engagement member 30 from inter-engagement with elongate member 20. Retention pins 60 are releasable and may be removed, and the engagement members 30 released from inter-engagement with elongate member 20 for ease of storage and/or transportation. It will be appreciated that use of the medical device 10 can be safely made without the need for retention pins 60 to be inserted through respective retention means 50 in elongate member 20. However, such a retention arrangement may be helpful in preventing engagement members 30 from sliding out of inter-engagement with elongate member 20 during manipulation of medical device 10 in order to correctly locate the device at the knees of a user, prior to subsequent use.

Figure 3A:
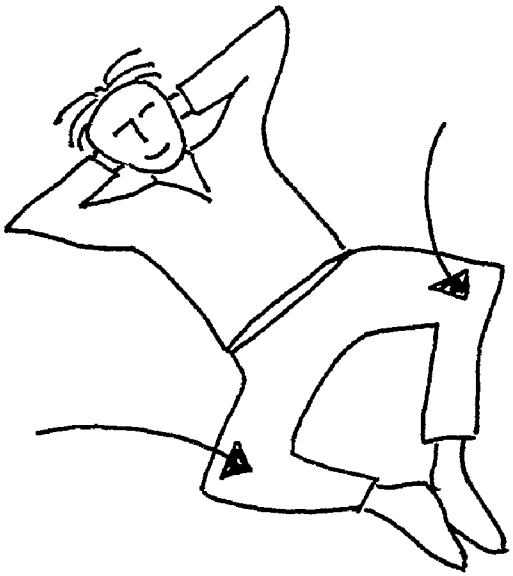

FIGS. 3A and 3B illustrate the position to be assumed by a user prior to use of medical device 10. However, the medical device 10 may be used by a user in a sitting position, provided the torso of the user is upright. When used in such a way, it is recommended that the user assume a sitting position on a front edge of a seat, with both feet together, the medical device 10 being placed and operated by the user in the same manner described below with reference to FIGS. 3A and 3B.

FIG. 3A shows a user in a supine position i.e. lying down and face-up, with both feet together. Medical device 10 is intended to be placed between the knees of the user as indicated by the arrows in figure. It is preferred that the engagement members are position between 9" and 12" apart. Once in place, the user pushes their knees together at full strength against the engagement members located to the inside of each knee of the user, whilst holding an inhaled breath for a count of eight seconds. Whilst is not essential for the user to hold their breath during the exercise, holding of the breath assists retention of strength. As the user exerts force on engagement members 30, they become non-slideable relative to the elongate member and thus fixed in place. The engagement members 30 of medical device 10 counteract the force exerted by the knees of a user, as the user brings their knees together at full strength. After a count of eight seconds, the user should release the pressure being exerted on the engagement region 40 of device 10 through their knees and resume normal breathing.

FIG. 3B illustrates a second exercise to be carried out using medical device 10, involving the user assuming a supine position, i.e. lying down and face-up, with the legs of the user bent and the feet placed towards the upper legs. The knees of the user must be kept together and the medical device 10 placed such that each engagement member 30 is located on the outside of a knee of the user. The user then applies force through their knees to put the knees apart at strength (but not full strength as used in the exercise discussed in relation to FIG. 3A), the user holding an inhaled breath as they do so, for a count of eight seconds. As the user applies force through their knees to push engagement members 30 apart from one another, engagement members 30 become fixed in position on elongate member 20, thus providing a counterforce against which the knees of the user are pushing. After a count of eight seconds, the user should release the pressure being exerted on the engagement region 40 of device 10 through their knees and resume normal breathing.

It is recommended that a user carries out both the above exercises once, and then repeats both exercises once more. The two exercises should be carried out in this way at least three times daily.

In the exercises discussed above with respect to FIG. 3A, the user, lying down or sitting, with their feet together acting as a fulcrum and the knees placed such as to be against the outer surface of the engagement members 30 of medical device 10, brings their knees together with great force against the engagement members 30 which counteract such force. In this way, the sacro-iliac joints of the user give way fractionally as does the joint at the pubic bone. This results in the specialised ligaments involved in the stabilisation of the pelvis resetting themselves. This addresses the source of the pain experienced by the user prior to carrying out the exercises, due to destabilisation of the pelvis with the pelvis becoming obliquely angled, as previously discussed.

In the exercises discussed above with respect to FIG. 3B, the knees are brought together and placed against the inner surfaces of engagement members 30 of device 10 and forced outwards against the engagement members 30. Thus the pelvis is encouraged to return its own joints to normal alignment, with the resultant alleviation of the pain of the user due to pelvic dysfunction.

The exercises discussed in relation to FIGS. 3A and 3B may be used by a user in combination with accompanying massage techniques, such as lumbar-rub techniques to assist in alleviation of back pain due to misalignment of the pelvis.

Although aspects of the invention have been described with reference to the embodiment shown in the accompanying drawings, it is to be understood that the invention is not limited to the precise embodiment shown and that various changes and modifications may be effected without further inventive skill and effort.

The invention claimed is:

1. An exercise device comprising:

an elongate member defining a longitudinal axis;

a plurality of engagement members;

wherein each of the plurality of engagement members comprises an engagement region and has a non-concentric aperture formed therein with respect to said engagement region;

wherein the elongate member extends through the plurality of apertures;

wherein, when each of the engagement regions is under no load, the plurality of engagement members are slideable along the elongate member; and wherein, when each of the engagement regions is placed under opposing loads applied in a direction parallel to the longitudinal axis, the plurality of engagement members are non-slideable along the elongate member due to frictional engagement between the plurality of engagement members and the elongate member.

2. The exercise device according to claim 1, wherein the aperture formed in each of the plurality of engagement members is elliptical in shape.

3. The exercise device according to claim 1, wherein a cross-section of the elongate member is elliptical in shape.

4. The exercise device according to claim 1, wherein the elongate member comprises a first retention aperture located adjacent a first end thereof.

5. The exercise device according to claim 4, wherein the elongate member further comprises a second retention aperture located distal to the first retention aperture.

6. The exercise device according to claim 5, wherein:

each of the first and second retention apertures are formed in the elongate member; and wherein the first and second retention apertures are adapted to receive a retention pin therethrough for retaining each of the plurality of engagement members in engagement with the elongate member.

7. The exercise device according to claim 1, wherein at least a portion of the engagement region comprises a resilient material.

8. The exercise device according to claim 7, wherein the resilient material comprises silicone.

9. The exercise device according to claim 1, wherein at least a portion of the elongate member comprises wood.

10. The exercise device according to claim 1, wherein at least a portion of the plurality of engagement members comprises wood.

11. The exercise device according to claim 1, wherein the device is a pelvic realignment device.

12. A method of pelvic realignment comprising:

providing an exercise device comprising:

an elongate member defining a longitudinal axis;

a plurality of engagement members;

wherein each of the plurality of engagement members comprises an engagement region and has a non-concentric aperture formed therein with respect to said engagement region;

wherein the elongate member extends through the plurality of apertures;

wherein, when each of the engagement regions is under no load, the plurality of engagement members are slideable along the elongate member; and wherein, when each of the engagement regions is placed under opposing loads applied in a direction parallel to the longitudinal axis, the plurality of engagement members are non-slideable along the elongate member due to frictional engagement between the plurality of engagement members and the elongate member;

placing the exercise device between knees of a user;

wherein a first engagement region of the plurality of engagement regions is adjacent an inside region of a left knee of the user;

wherein a second engagement region of the plurality of engagement regions is adjacent an inside region of a right knee of the user;

applying pressure on the plurality of engagement regions of the device by moving the left and right knees towards each other;

responsive to the applying step, the plurality of engagement regions becoming in a fixed orientation along an elongate member due to frictional engagement between the plurality of engagement regions and the elongate member;

maintaining, for a predetermined time period, the plurality of engagement regions in the fixed orientation; and releasing pressure on the plurality of engagement regions by moving the left knee and the right knee away from each other.

13. A method of pelvic realignment comprising:

providing an exercise device comprising:

an elongate member defining a longitudinal axis;

a plurality of engagement members;

wherein each of the plurality of engagement members comprises an engagement region and has a non-concentric aperture formed therein with respect to said engagement region;

wherein the elongate member extends through the plurality of apertures;

wherein, when each of the engagement regions is under no load, the plurality of engagement members are slideable along the elongate member; and wherein, when each of the engagement regions is placed under opposing loads applied in a direction parallel to the longitudinal axis, the plurality of engagement members are non-slideable along the elongate member due to frictional engagement between the plurality of engagement members and the elongate member;

placing the exercise device between knees of a user;

wherein a first engagement region of the plurality of engagement regions is adjacent an outside region of a left knee of the user;

wherein a second engagement region of the plurality of engagement regions is adjacent an outside region of a right knee of the user;

applying pressure on the plurality of engagement regions of the device by moving the left and right knees away from each other;

responsive to the applying step, the plurality of engagement regions becoming in a fixed orientation along an elongate member due to frictional engagement between the plurality of engagement regions and the elongate member;

maintaining, for a predetermined time period, the plurality of engagement regions in the fixed orientation; and releasing pressure on the plurality of engagement regions by moving the left knee and the right knee towards each other.

* * * * *

UNITED STATES PATENT AND TRADEMARK OFFICE

CERTIFICATE OF CORRECTION

PATENT NO. : 7,993,252 B2
APPLICATION NO. : 12/066471
DATED : August 9, 2011
INVENTOR(S) : Alexander Barrie et al.

It is certified that error appears in the above-identified patent and that said Letters Patent is hereby corrected as shown below:

Title Page, Item (73)

Assignee:

Replace "Backchamp Holdongs Ltd." in Assignee Name with --Backchamp Holdings Ltd.--

Signed and Sealed this
Twenty-fifth Day of October, 2011

David J. Kappos

David J. Kappos
*Director of the United States Patent and Trademark Office*